United States Patent [19]

Hartley et al.

[11] Patent Number: 4,705,217

[45] Date of Patent: Nov. 10, 1987

[54] MATERIAL MIXING AND SPRAYING APPARATUS

[76] Inventors: David H. Hartley, P.O. Box 11 Mill Cir.; Dick Sellers, Valley View Trailer Park Lot 28, both of Byron, Ga. 31008

[21] Appl. No.: 923,962

[22] Filed: Oct. 28, 1986

[51] Int. Cl.[4] ..... B67D 5/52

[52] U.S. Cl. ..... 239/142; 239/304; 222/135; 222/255; 222/263

[58] Field of Search ..... 239/124, 126, 127, 142, 239/303, 304, 407, 413; 222/135, 255, 263

[56] References Cited

U.S. PATENT DOCUMENTS

| | | | |
|---|---|---|---|
| 2,596,074 | 2/1948 | Hawes . | |
| 2,815,767 | 1/1957 | Kurns . | |
| 3,079,050 | 3/1960 | Wahl . | |
| 3,203,631 | 5/1964 | Jutila | 239/124 |
| 3,889,850 | 6/1975 | Whitt . | |

OTHER PUBLICATIONS

"Series PVP Variable Displacement Piston Pumps"; Application and Performance 11, BS Double A, Hydraulics by Brown & Sharpe; ©Double A 1980; Printed in USA 5/81.

*Primary Examiner*—Andres Kashnikow
*Assistant Examiner*—Karen B. Merritt
*Attorney, Agent, or Firm*—Louis T. Isaf

[57] ABSTRACT

An improved mixing and spraying system comprises: one or more pairs of material mixing tanks wherein both tanks of each pair selectively and alternately exhaust into a single common material exhaust assembly and discharge through a single spray nozzle whereby continuous mixing and spraying procedures can be simultaneously maintained; a unique, combination, materials grating and filtering system associated with each tank; remote control apparatus for remotely controlling the rate of material flow from the spray nozzle; method and apparatus for operating numerous hydraulic motors at the same time; and method and apparatus for maximizing the use of hydraulics and hydraulic motors while eliminating the use of gears and pulleys for driving motors.

9 Claims, 8 Drawing Figures

MATERIAL MIXING AND SPRAYING APPARATUS

FIELD OF THE INVENTIO

This invention relates generally to the field of mixing and spraying equipment, and more specifically to equipment designed for the mixing and spraying of texture materials and acoustical materials on building walls (interior and exterior) and ceilings.

BACKGROUND OF THE INVENTION

Mixing and spraying rigs have been used for years by builders to apply textured and/or acoustical materials to walls and ceiling of buildings. The equipment used for such processes has made great strides over the years as evidenced by U.S. Pats. Nos. 2,596,074 HAWES, 2,815,767 KURNS and 3,889,850 WHITT. In spite of the progress made, numerous problems remain with the prior equipment which makes operation of the equipment and application of the materials less efficient than is desirable.

Mixing and spraying equipment is notorious for having numerous breakdowns. Such breakdowns are typically due to the fact that the equipment comprises a large number of mechanical parts such as pulleys, chains, belts, sprockets, gears and clutches. Breakdowns, resulting in down-time at the job site, are a well known frustration of laborers in the industry. Some prior art devices such as that disclosed by Whitt in his U.S. Pat. No. 3,889,850, went a long way to reduce the number of pulleys, chains, belts, gears and clutches. However, a certain number of gears, pulleys, belts and chains still remain and still breakdown.

Another frustration of laborers utilizing prior art mixing and spraying equipment is the frustration of down-time occurring during the materials mixing process. This is due to the prior art equipment constraints which require that the machine be either used for mixing or used for spraying. Thus, during the mixing process, the user cannot be applying materials to the building, and vice versa.

At least a few prior art systems, including the Whitt apparatus, have sought to use hydraulics, hydraulic pumps and motors, to lessen the number of mechanical parts required on the mixing and spraying apparatus. In spite of their good efforts, problems still remain in the design of the various pre-existing hydraulic systems which render the prior equipment incapable of performing multiple functions simultaneously, and, which also have made it necessary to maintain at least a vestage of mechanical parts such as pulleys, gears, belts and chains as driving components of the apparatus.

It has also been observed that prior art systems encounter difficulty with clogged spraying hoses due to the absence of filtering systems or the existence of in-line filtering systems (in the material spray hose) which require cleaning out or other maintenance. Furthermore, remote control of the hydraulic motor effecting material flow to the nozzle is typically accomplished in the prior art by the cumbersome use of dual flow control devices (i.e. by-pass valve and solenoid valve combination of U.S. Pat. No. 3,889,850) which control the amount of hydraulic fluid flowing through the hydraulic motor. Such prior art techniques provide unsatisfactory control of the material flow.

SUMMARY OF THE INVENTION

Briefly described, the present invention defines a mixing and spraying apparatus which comprises a plurality of tanks and mixing mechanisms uniquely operated by hydraulics to completely eliminate all pulleys, chains, sprockets, gears, clutches and belts. At least two tanks are provided with independently controlled mixing apparatus for each tank. The two tanks are uniquely exhausted through a common material exhaust assembly and thus through a common spray nozzle. Material can be drawn from the two tanks either simultaneously or alternately for discharge through the common spray nozzle.

In some embodiments, additional pairs of tanks are added which have exhaust assemblies common to each pair. The two tanks within a pair of tanks each have a mixing apparatus controlled independantly of that of the ohter tank of the pair. All driving elements such as mixing assembly drive shafts and spray discharging pumps are driven by hydraulic motors mounted directly on their respective driven shafts. The hydraulics of the present invention comprise a pressure sensing network uniquely designed to sense the fluid needs of the hydraulic network. The hydraulic system of the present invention provides only the amount of hydraulic fluid required by the system to operate selected hydraulic motors, yet, it also provides all of the fluid and fluid pressure required to operate all of the hydraulic motors simultaneously and efficiently.

The mixing and spraying apparatus further comprises a combination of elements related to the mixing apparatus and the material exhaust assemblies which cooperate to provide lump free mixing and filtering of the materials pumped through the spray nozzles.

The mixing and spraying apparatus of the present invention comprises a single source of power driving a single hydraulic pump. In turn the hydraulic pump drives all of the hydraulic motors of the system. The hydraulic motors, by use of flow controls and the sensing network of the present invention, will operate independently or all at once, though still driven by the single hydraulic pump. In the four tank embodiment, two of the motors are used to agitate and mix material; two different motors are used to turn materials-discharge pumps. Each of the materials-discharge pumps draws material from two tanks through a common exhaust assembly associated with the pair of tanks. Still another motor is used to drive the air compressor. The air compressor supplies air to spray nozzles for propelling material from the nozzles. A single, remotely controlled, flow control valve provides selective and variable control of the hydraulic motor driving a materials-discharge pump, and thus provides remote control of both the flow and rate of flow of material from the discharge pump.

It is, therefore, an object of the present invention to provide a mixing and spraying device which is relatively more dependable than known prior art equipment.

Another object of the present invention is to provide a mixing and spraying apparatus which operates without the use of gears, pulleys, chains, clutches or belts.

Yet another object of the present invention is to provide a mixing and spraying apparatus which provides for two different operations (mixing and spraying) to be performed at the same time with the use of only one macine, thus allowing continuous discharge of material through a single spray nozzle.

Still another object of the present invention, in preferred embodiments, is to provide a mixing and spraying apparatus which mixes and sprays two different materials at the same time, through two different nozzles, while at the same time performing two different operations (mixing and spraying) on each of the two different materials.

Another object of the present invention is to provide a mixing and spraying apparatus with a combinatio of elements functioning to provide smooth, filtered material at the discharge end.

Another object of the present invention is to provide a mixing and spraying apparatus including selective and variable control of the flow and rate of flow of material from the remote, spray nozzle.

Other objects, features and advantages of the present invention will become apparant upon reading and understanding the specifications when taken in conjunction with the accompanying drawings.

BRIEF DESCRIPTION OF THE DRAWINGS

FIG. 6 is a schematic representation of the hydraulic network of the apparatus of FIG. 1.

DETAILED DESCRIPTION OF THE PREFERRED EMBODIMENTS

Figure 1:
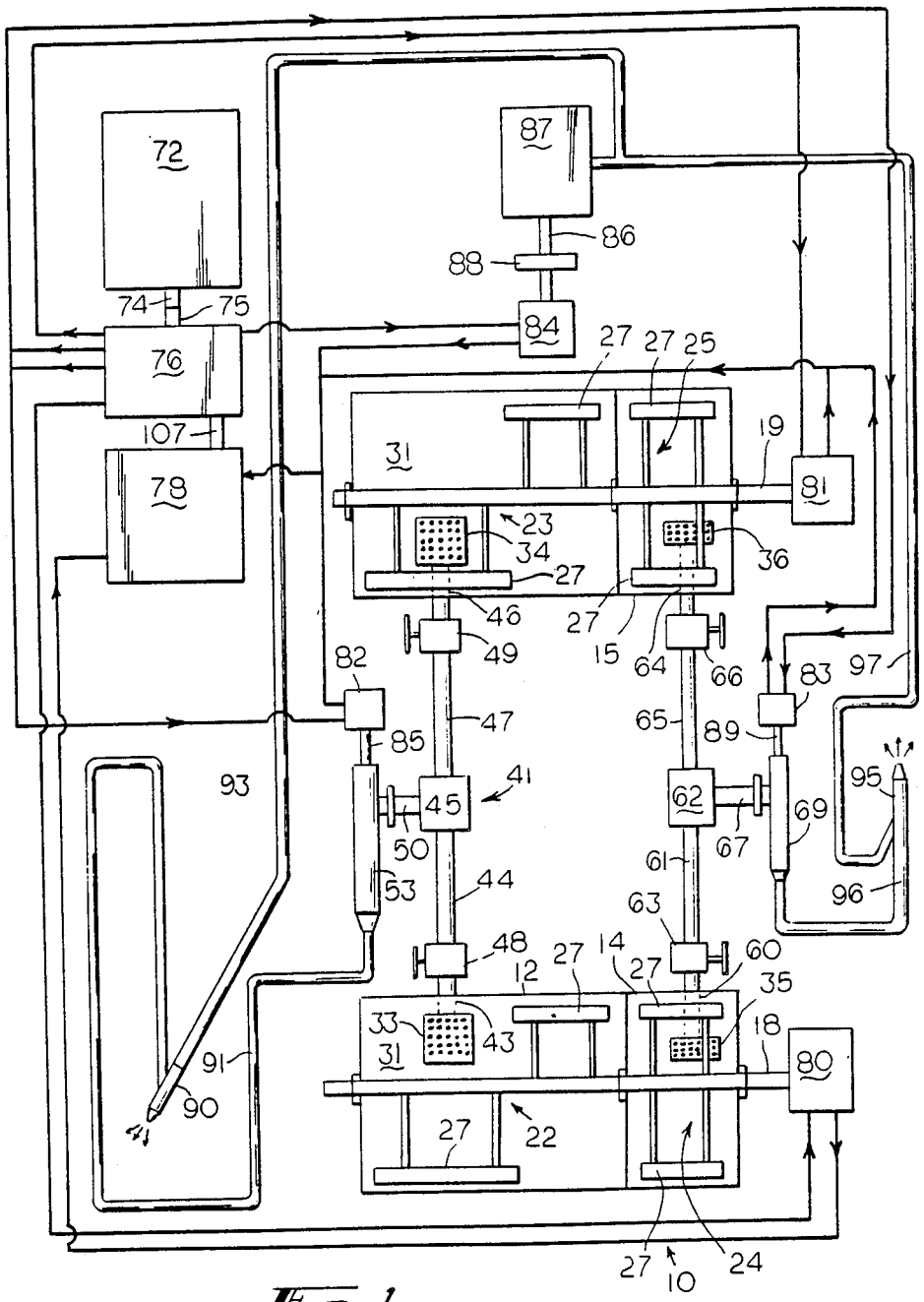
FIG. 1 is a schematic representation of the mixing and spraying apparatus in accordance with the present invention, showing a four tank embodiment thereof.
Figure 2:
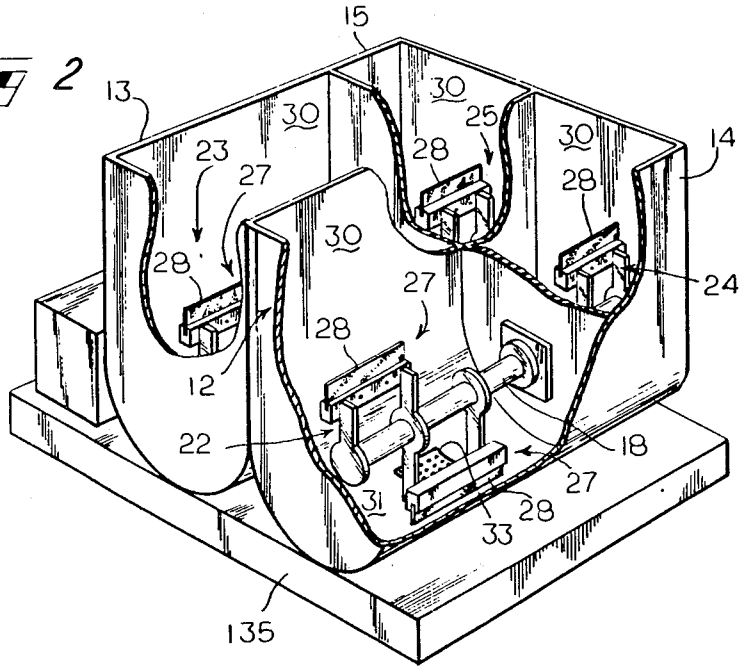
FIG. 2 is an isolated, cutaway view of the tank portion of the mixing and spraying apparatus of FIG. 1.
Figure 3:
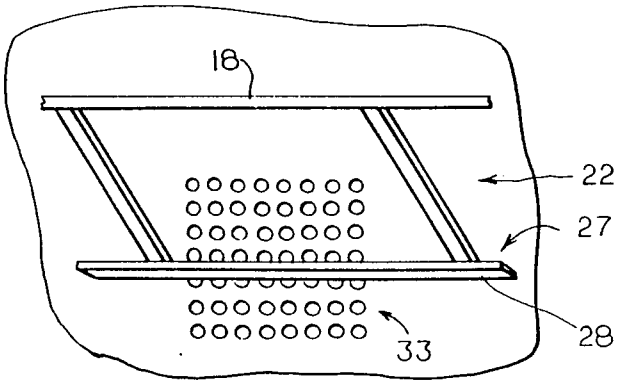
FIG. 3 is an isolated view of the perforated outlet segment of the apparatus of FIG. 1, as scraped by the blade element.

Referring now in greater detail to the drawings in which like numerals represent like components throughout the several views, FIG. 1 presents a schematic representation of a four tank embodiment of the mixing and spraying apparatus 10, in accordance with the present invention. The apparatus 10 of the present invention is seen as having four material holding tanks 12, 13, 14, 15. Each tank comprises an inner wall 30 formed with a bottom portion 31 in the shape of a semicircular trough 31. (See also FIG. 2.) A drive shaft 18 extends through two of the tanks 12, 14 and is mounted for rotation along its axis. A second drive shaft 19 extends through the other two tanks 13, 15 and is mounted for rotation along its axis. There are four agitator assemblies 22, 23, 24, 25. One agitator assembly is associated with each of the four tanks 12–15. Two of the agitator assemblies 22, 24 are attached to and connected for rotation with the first drive shaft 18. Two agitator assemblies 23, 25 are attached to and connected for rotation with the second drive shaft 19. Although the agitator assemblies 22–25 vary in size and arrangement, each of the agitator assemblies includes a wiper or blade element 27 supported at a distance removed from its respective drive shaft 18, 19. The edge 28 of the blade element 27 scrapes the inner wall 30 of its respective tank 12–15. The scraping takes place along an arc preferrably encompassing the lower semi-circular trough 31 of its respective tank. A perforated outlet segment 33, 34, 35, 36 is defined in the bottom of each tank. The perforated outlet segment 33–36 is located in the semicircular trough section 31 of each tank at a point in the trough which is scraped by the blade element 27 of the agitator assembly 22–25.

The perforated outlet segment 33–36 comprises a plurality of perforations whic are drilled directly into and through the inner wall 30 of the respective tanks 12–15. The size of the outlet segment and the size of the perforations are a carefully determined, experimental and inventive feature which will vary depending mostly upon the type of material being mixed and pumped and the outlet volume desired. In the preferred embodiment, the perforated outlet segment 33, 34 of two of the tanks 12, 13 (left tanks) is an eight inch by eight inch segment with perforations of three eighth inch diameter, one half inch aprt. The perforated outlet segments 35, 36 of the other two tanks 14, 15 (right tanks) are a five inch by eight inch segment with perforation sof five sixteenths inch diameter, five sixteenths inch apart. These segment specifications are determined for spraying of typical ceiling texture with aggregate from the left tanks 12, 13 and for spraying of typical wall texture material without aggregate from the right tanks 14, 15. It is within the scope of the present invention to provide embodiments in which the perforated outlet segments 33–36 comprise movable screens which are inset into the inner wall 30 of the respective tanks 12–15 so as to be flush with the inner wall 30 of the trough 31. In these embodiments, the screen elements with perforations of varying diameter and arrangement are interchangeable to accommodate different materials to be mixed and sprayed from the tank. Whereas, the screen elements used in accordance with alternate embodiments of the present invention are themselves an element of the present invention, it is highly preferred, and considered a separate element of invention, that the perforated outlet segments 33–36 are not removeable screens but comprise perforations formed directly in and flush with the inner walls 30 of the respective tanks. This eliminates yet another mechanical part which would become damaged and result in equipment down-time.

Figure 4:
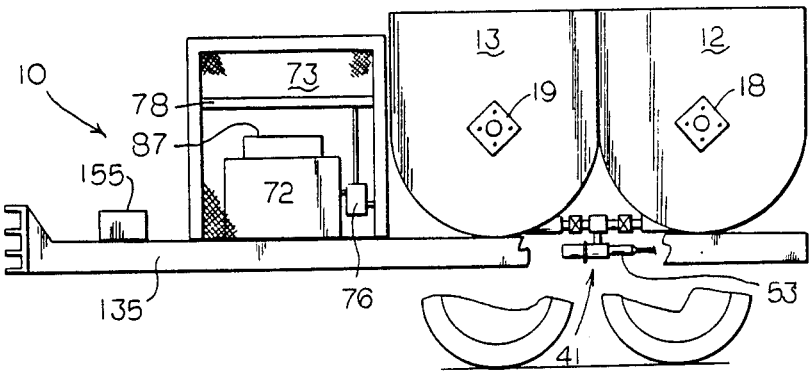
FIG. 4 is a left side view of the mixing and spraying apparatus of FIG. 1.

Associated with the two left tanks 12, 13 is, as seen in FIGS. 1 and 4, a common outlet assembly 41 which comprises an outlet channel 43 in draining communication wit the outlet segment 33, and pipe 44 connecting the outlet channel 43 through a junction pipe 45. Also comprising the left common outlet assembly 41 is an outlet channel 46 connected to tank 13 in draining communication with the perforated outlet segment 34 and a pipe 47 connecting the outlet channel 46 to the junction pipe 45. A cutoff valve 48 is positioned in pipe 44 and another cutoff valve 49 is positioned in the pipe section 47. An outlet pipe 50 connects the exchange box 45 to a first materials-discharge pump 53.

Figure 5:
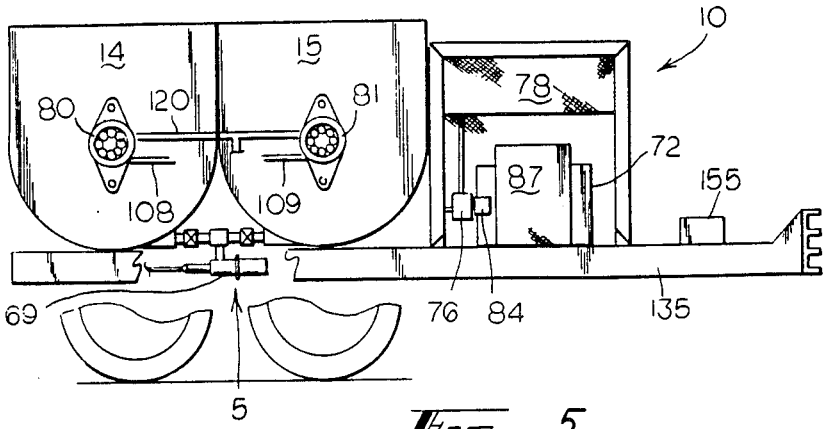
FIG. 5 is a right side view of the mixing and spraying apparatus of FIG. 1.

Associated with the two right tanks 14, 15 is another outlet assembly (right, common outlet assembly) 58. As seen in FIGS. 1 and 5, this right outlet assembly 58 includes an outlet channel 60 connecting to and communicating with the inner chamber of tank 14 through the perforated outlet segment 35. A pipe 61 leads from the outlet channel 60 to a junction pipe 62. The pipe 61 is outfitted with a cutoff valve 63. Another outlet channel 64 is connected to tank 15 and communicates with the inner chamber of tank 15 through the perforated outlet segment 36. A pipe 65 connects the outlet channel 64 to the junction pipe 62 and is outfitted with a cutoff valve 66. An outlet pipe 67 connects the junction pipe 62 to a second materialsdischarge pump 69.

The mixing and spraying apparatus 10 of the present invention is provided with a single power source 72 such as, for example, a gasoline engine. Gasoline is stored in the fuel tank 73. The power source 72 is connected by a power shaft 74 directly to the drive shaft 75 of a single hydraulic pump 76. The hydraulic pump 76 draws hydraulic fluid from a reservoir 78 and supplies the fluid through a hydraulic network (described below) to drive a series of hydraulic motors. In the preferred, four tank embodiment of the present invention, the hydraulic pump 76 drives five hydraulic motors, 80, 81, 82, 83, 84. The first hydraulic motor 80 is mounted in direct driving relationship with the agitator shaft 18. By direct drive relationship is meant that the shaft 18 is driven directly by the output shaft of the motor without requiring gearing or pulleys. The second hydraulic motor 81 is mounted in direct drive relationship with the agitator shaft 19. The third motor 82 is in direct drive relationship with the input shaft 85 of the first materials-discharge pump 53. The fourth hydraulic motor 83 is in direct drive relationship with the input shaft 89 of the second materials-discharge pump 69. The fifth hydraulic motor 84 is in direct drive relationship with the drive shaft 86 of an air compressor 87. The cooling fan 88 for the air compressor 87 is mounted on the same compressor drive shaft 86, thus requiring no gearing or pulleys.

A first spray nozzle 90 is connected by discharge hosing 91 to the outlet of the first materials-discharge pump 53. Air hose 93 connects the first spray nozzle 90 to the air compressor 87. A second spray nozzle 95 is connected by another discharge hose 96 to the outlet of the second materials-discharge pump 69. An air hose 97 connects the second spray nozzle 95 to the air compressor 87. The materials-discharge pumps 53, 69 are preferably of the type known as a progressing cavity pump (or rotor/stator pump) such as the ROBBIS & MEYERS MOYNO® pump.

The Hydraulic Network. With reference to FIG. 6, the hydraulic network in accordance with the present invention comprises a network of tubing for directing flow of fluid from the reservoir 78, through the hydraulic pump 76 to and through each of the hydraulic motors 80–84 and back to the reservoir. The five motors 80–84 are arranged in a parallel grouping, relative to one another. That parallel grouping of motors is arranged in series with the reservoir 78 and pump 76. That is, fluid passes from the pump 76 directly and independently through each motor 80–84 without passing through another motor, and then to the reservoir 78. Associated with each hydraulic motor 80–84 is a flow control device 99, 100, 101, 102, 103 positioned between the respective motor and the hydraulic pump 76.

Referring to the schematic of FIG. 6, the following fluid conduits are seen: suction line 107 between the reservior 78 and pump 76; common supply line 108 between the pump and flow control valve 99; second supply line 109 branching from common supply line 108 to flow control valve 100, bypassing flow control valve 99; third supply line 110 branching from common supply line 108 to flow control valve 101, bypassing flow control valve 99 and 100; fourth supply line 111 branching from third supply line 110 and connecting to flow control valve 102, bypassing flow control valve 99, 100 and 101; fifth supply line 112 branching from common supply line 108 and connecting with flow control valve 103, bypassing all other control valves. Supply line 114 connects flow control valve 99 to hydraulic motor 80; supply line 115 connects flow control valve 100 to hydraulic motor 81; supply line 116 connects flow control valve 101 to hydraulic motor 82; supply line 117 connects flow control valve 102 to motor 83; and supply line 118 connects flow control valve 103 to motor 84. All of the hydraulic motors 80–84 connect to a common fluid return line 120 which connects to the reservoir 78.

Figure 7:
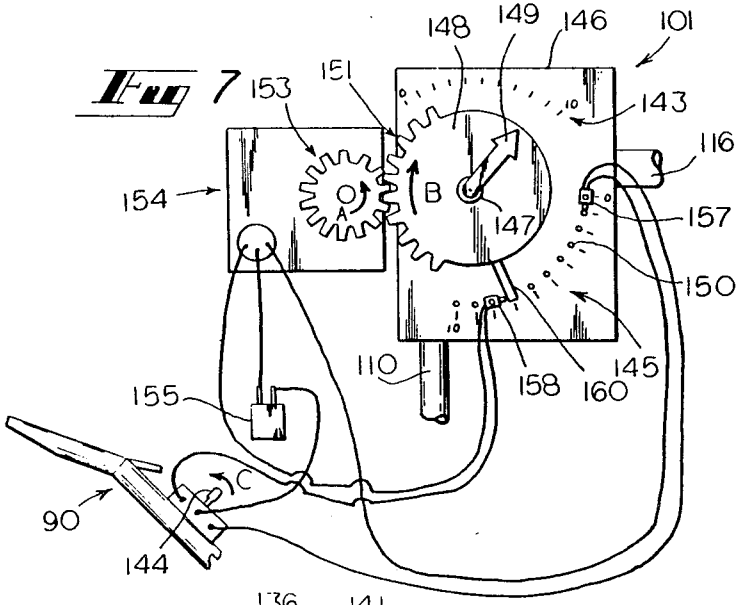
FIG. 7 is an isolated view of a remotely operated control valve and its associated parts, in accordance with the present invention.

Three of the flow control devices 99, 100, 103 are manually operated control valves of a type known in the art. Using the manually operated control valves 99, 100, 103, the user turns the valve to selectively vary the rate of flow of hydraulic fluid through the valve from some minimum (i.e., no flow) to some maximum flow. Two of the flow control devices 101, 102 are unique to the present invention and constitute remotely operated control valves. A remotely operated control valve 101 is shown in detail in FIG. 7, of which the other 102 is similar. Each remotely operated control valve 101, 102 is controlled by a remote switch 144, preferrably a double pole, rocker type switch, mounted at one of the spray nozzles 90, 95, one switch at each nozzle. Each remotely operated control valve 101, 102 comprises a flow divider unit 146 having an inner passage and valve member (not seen) for selectively varing fluid flow through the inner passage in a typical manner. Mounted to the valve stem 147 is a gear 148 with affixed indicator needle 149. Numbered hash markings 143 (numbered "0" through "10") representing the degree of valve opening are indicated on the flow divider unit 146. A second set of numbered hash markings 145 (numbered "0" through "10") are indicated on the divider unit 146 offset from the first set 143. Threaded holes 150 are bored at each of the hash marks of the second set of markings 145. The markings of the two sets 143, 145 are equally spaced. The gear teeth 151 of the gear 148 are in driven contact with a drive sprocket 153 of an electric motor 154 powered off the 12-volt battery 155. The electric motor 154 is a reversible motor turning in the forward direction (arrow A) to turn gear 148 and the valve clockwise (arrow B), thus increasing fluid flow, when the rocker switch 144 is moved forward (direction of arrow C). When the rocker switch is moved backward (opposite arrow C), the motor reverses, turning the gear 148 and valve opposite arrows A and B to lessen fluid flow through the flow divider unit 146. When the rocker switch 144 is released, it remains at the center of the rocker (neutral position), the motor 154 does not operate, the gear 148 does not turn and the fluid flow through the divider unit 146 remains at a steady rate wherever last placed by the gear. Limit switches 157, 158, electrically wired to break current to the electric motor 154, are mounted to the housing of the flow divider unit 146. One limit switch 157 (the lower-limit limit switch) is mounted at the "0" marking of the second set of markings 145. The other limit switch 158 (the upper-limit limit switch) is screwed into one threaded hole 150 along the markings 145, yet is removable and is reattachable to a different one of the threaded holes 150 along the second set of markings 145. A switch striking pin 160 protrudes from the gear 148 between the two limit switches 157, 158. The pin 160 is positioned so as to strike the lower-limit limit switch 157 when the indicator needle 149 is at the "0" mark of the first set of markings 143.

Pressure Sensing Network. FIG. 6 also shows the schematic representation of a pressure sensing network designed in accordance with the present invention. This network comprises sensor delivery lines 122, 123, 124, 125, 126, 127, 128, 129, 130 and a sensor return line 133. Also included in the sensor network are pressure sensitive valves 136, 137, 138, 139. One type of pressure sensitive valve 136–139 utilized in the preferred embodiment is a shuttle valve 136, shown in detail in FIG. 8. The sensor network delivery lines 122–129 feed, as seen in FIG. 6, from each of the hydraulic network, fluid supply lines 114–118 through the pressure sensitive valves 136139 to the hydraulic pump 76. An intergral element of the hydraulic pump 76 is the pressure control assembly (pressure compensator assembly) 134 and the sensor network connects to this pressure control assembly. In the preferred embodiment of the present invention, the hydraulic pump 76 is of a type known in the industry as a variable displacement pump. An example of such a variable displacement pump is the series PVP, AA model, variable displacement system pump made by Brown & Sharpe. The operation of this pump and its pressure compensator assembly 134 is known in the industry and, therefore, is not described herein. The particular interrelationship of elements constituting the sensor network and hydraulic network is, however, considered inventive and unique to the present invention and is more fully described under "Operation" below.

Operation. Initial operation is described with respect to a two tank system assembled in accordance with the present invention, as described above. The two tank system is constructed as described above with two side-by-side tanks; for example, the two left tanks 12, 13, each being associated with a separate drive shaft 18, 19. With the apparatus fully constructed and mounted on a wheeled carriage 135, as seen in FIGS. 4 and 5, the mixing and spraying apparatus 10 is towed to a job site. At the job site, the gasoline engine 72 is started, water and material mixture for a single, textured or acoustical material are placed in both of the tanks 12, 13. Quantities of water and material mixture are in proportions known in the art. At this initial point, all of the flow control valves 99–103 are closed down so as to shut off flow of hydraulic fluid through the various fluid supply lines 114–118 to the hydraulic motors 80–84. In this condition, there is no demand for fluid flow to the various hydraulic motors 80–84.

Figure 8:
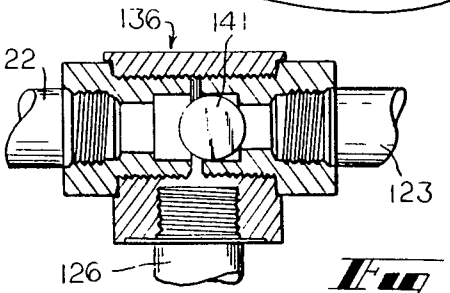
FIG. 8 is a cutaway view of a pressure sensitive valve used in the apparatus of FIG. 1.
Figure 9:
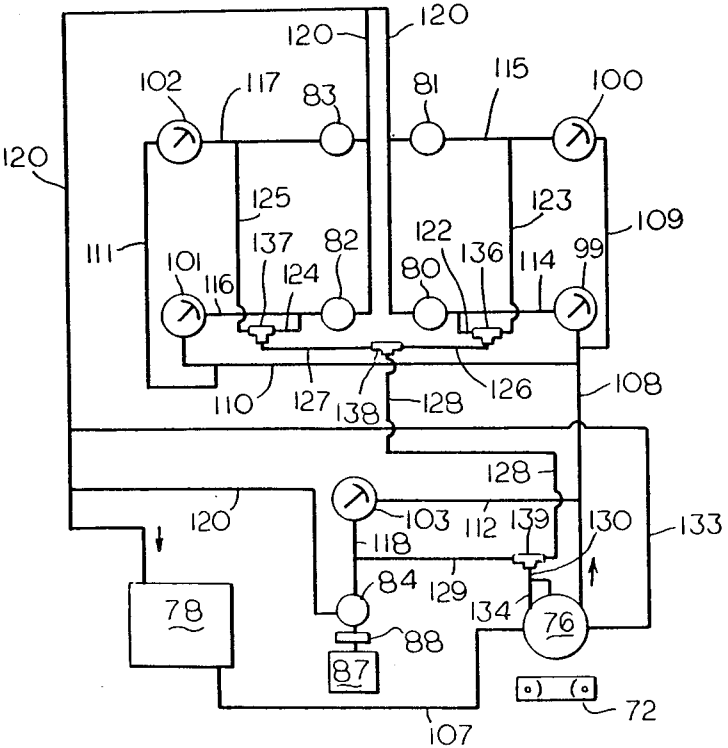

In operation, the pressure sensing network functions to sense the pressure of fluid flowing between the various flow control valves 99–103 and each of their respective hydraulic motors 80–84. The sensed pressure of fluids is communicated by means of the various sensor delivery lines 122–130 and pressure sensitive valves 136–139 to the pressure control assembly 134 of the hydraulic pump 76. For example, if flow control valve 99 is open, fluid will flow through the flow control valve 99 into the supply line 114 to operate the hydraulic motor 80. When the fluid flow hits resistance of the motor 80, a pressure builds up in supply line 114. The pressure in supply line 114 is sensed by sensor delivery line 122 by virtue of the pressure "backfeeding" fluid into that sensor delivery line 122. Fluid flowing through fluid delivery line 122 flows through shuttle valve 136, then sensor delivery line 126, then shuttle valve 138, then through sensor delivery line 128, then through shuttle valve 139, then through sensor delivery line 130 into the pressure control assembly 134 of the hydraulic pump 76. In like manner, as flow control valve 100 is opened, hydraulic fluid flows through supply line 115 to hydraulic motor 81. The flow of hydraulic fluid through supply line 115 is detected by sensory delivery line 123 since fluid will also flow through that delivery line 123. Fluid flowing through sensor delivery line 123 then flows through pressure sensitive (shuttle) valve 136, then sensor delivery line 126, then shuttle valve 138, then sensor delivery line 128, then shuttle valve 139, then sensor delivery line 130, to the pressure control assembly 134. Note that two sensor delivery lines (i.e. 122 and 123) share the same shuttle valve (i.e. 136). As seen in FIG. 8, a ball element 141 moves within the inner chamber of the shuttle valve 136–139 to compensate for the flow of fluid from one or the other two entrances (i.e. line 122 or line 123) or from both of the entry lines. The pressure build up in the supply lines, and thus the displacement and pressure demands on the pump 76 is varied by factors such as load on the hydraulic motors and degree of opening of the flow control valves 99–103.

The fluid pressure delivered through sensor delivery lines 122–130 is communicated to the pressure control assembly 134. The pressure control assembly 134 automatically controls the variable displacement of the hydraulic pump 76, such that the hydraulic pump delivers only the amount of fluid flow and pressure required to operate the specific motors 80–84 which are "turned on" through opening of their respective flow control valves 99–103. The variable and automatically controlled operation of the hydraulic pump 76 is as known in the art and, therefore, is not further discussed herein. Reference is made to the operation of cited variable displacement pump, series PVP, manufactured by Brown and Sharpe.

The user of the mixing and spraying apparatus 10 of the present invention begins operation with all of the flow control valves 99–103 in their fully closed (no flow) position. With all flow control valves in the no flow position, there is no hydraulic fluid flowing through any sensor delivery lines 122–130 to the pressure control assembly 134 of the hydraulic pump 76. Thus, in the manner known in the art, the pump 76, through being driven by the engine 72, remains in an "idle" mode maintaining a designed, minimum fluid pressure in the supply line, but displacing no hydraulic fluid through the hydraulic network.

The gasoline engine 72 is mounted directly for continuous drive, to the input shaft 75 of the hydraulic pump. Connection is made between the engine 72 and pump 76 directly through the power shaft 74 and input shaft 75 for continuous, direct drive, without a clutch mechanism, and without gears or pulleys. In this way, the hydraulic pump 76 is constantly in operation during operation of the gasoline engine 72; and displacement of fluid by the pump 76 through the hydraulic network to the various hydraulic motors 80–84 is dictated by the unique interaction of the hydraulic network, flow control valves 99–103 and sensor network with the pressure control assembly 134 of the hydraulic pump 76.

The user will then begin the mixing operation of the invented apparatus 10 by manually opening flow control valves 99, 100 which connect to the agitator drive shafts 18, 19. At this point, both cut off valves 48, 49 to the common outlet assembly 41 are closed off to prevent flow from the tanks 12, 13. As flow control valves 99, 100 are opened, fluid is allowed to flow through their respective supply lines 114, 115 and pressure in the lines is sensed by the respective sensor delivery lines 122, 123, thus conveying the requirement for a certain amount of fluid displacement and pressure to operate the two mixer motors 80, 81. With the agitator motors 80, 81 operating, the agitator assemblies 22, 23 operate, with their agitator blades 27 rotating to mix the materials within the tanks. Once mixing is complete, the user now hs two full tanks of the same material ready for spraying onto the wall or ceiling surface. Spraying can now begin. The user opens one cutoff vlve 48 to allow the flow of materials from tank 12 to the junction pipe 45 and into the materialsdischarge pump 53. At this point, the mixing operation can be halted by closing off the flow control valve 99 or continued with the agitator 22 rotating at selected, variable speeds as controlled by the variable degree of opening of the flow control valve 99. The user will manually open flow control valve 103 to direct fluid flow to the hydraulic motor 84 which operates the air compressor 87 and its associated fan 88. The sensor network operates in the manner discussed herein to demand added displacement from the pump 76 to operate motor 84 simultaneously with the other operating hydraulic motors.

In order to operate the materials-discharge pump 53, the user will now carry the spray nozzle 90, associated with the pump 53 to the location to be sprayed. Pushing the rocker switch 144 forwrad, the user remotely opens the remotely operated control valve 101, as explained above, thus allowing hydraulic fluid to flow to and operate the hydraulic motor 82. This hydraulic motor 82 is mounted in direct drive relationship with the materials-discharge pump 53 so as to immediately begin operation of the pump, without the use of clutches, gears or pulleys, as soon as the hydraulic motor 82 begins operation. The speed of the pump 53 is controlled by the operating speed of the hydraulic motor 82 as determined by the relative hydraulic fluid flow selected by the degree of opening of flow control valve 101. With flow control valve 101 open, flow of fluid through supply line 116 is sensed by sensor delivery line 124 which delivers fluid pressure through shuttle valve 137, sensory delivery line 127, shuttle valve 138 to sensor delivery line 128 and thus through the remaining sensor network to the pressure control assembly 134. At this point, the pump 76 is automatically controlled to deliver the required amount of fluid flow and pressure as required by the relative needs of the now operating hydraulic motors 82, 84 (and 80 and 81 if still operating).

With the materials-discharge pump 53 operating, the mixed materials from tank 12 are pumped through the outlet assembly 41 to and through the materials-discharge pump 53, through the discharge hosing 91 to and through the first spray nozzle 90. As the materials reach the spray nozzle 90, air from the air compressor 87 fed through the associated air hose 93 meets the fluid at the spray nozzle 90 and accelerates discharge of the material for application to the wall or ceiling, as appropriate. As described above, the user remotely controls the rate of material flow from the discharge pump 53 by forward-neutral-backward movement of the rocker switch 144 located at spray nozzle 90, which remotely increases-maintains-decreases the flow of hydraulic fluid to the hydraulic motor 82. The limit switches 157, 158 prevent the remote user from "overshooting" the valve closed and open positions. The lower-limit limit switch 157 cuts-off the electric motor 154 when the gear 149 has rotated the electric motor 154 to the fully closed ("0") position. The upper-limit limit switch 158 is movable to establish a desired maximum valve opening. Thus, with the limit switch 158 inserted at marking "8" of the second set 145, the limit switch 158 will be tripped by the striking pin 160 upon the indicator needle reaching marking "8" of the first set 143, during clockwise rotation. It is seen that, in this manner, the user selectively presets the desired maximum rate of material outflow.

During the pumping and discharge from tank 12, it is preferred that the agitator assembly is maintained in at least a minimum speed of rotation such that blade element 27 continue to rotate and scrape along the perforated outlet segment 33. In this manner, the combined operation of the agitator blade edge 28 and outlet segment 33 functions to scrape and mash lumps of materials which may be adjacent the outlet, thus assuring good mixing and desired material consistency at the outlet assembly 41. The outlet segment also functions as a filtering element preventing the flow of foreign objects and large lumps of material into the outlet assembly 41; while, simultaneously, the blade element 27 assists in filtering by sweeping the filtered materials away from the outlet segment 33 to aid the flow of materials from the tank 12.

Once the first tank 12 has been pumped dry of material, the user turns on cutoff valve 49 to allow flow of materials from the second tank 13 into the outlet assembly 41. At the same time, cutoff valve 48 is turned off completely to stop the flow of materials from tank 12; new material and water are placed in the first tank 12 and the flow control valve 99 is opened a desired mount to speed up the hydraulic motor 80, operating the agitator assembly 22 so as to mix a new batch of materials. It is noted that this process creates a continuous spraying operation. That is, while the second tank 13 is being discharged for spraying, the first tank 12 is being prepared for mixing of fresh material. Thus, when tank 13 is empty, the user can immediately switch back to tank 12 and prepare a new mixture in the second tank 13.

In the four tank embodiment, as shown in the drawing, the apparatus of the present invention is used for simutaneously mixing and spraying two different materials (for example, a texture material with aggregate or ceiling coating and a texture material without aggregate or a wall coating.) In this type of operation, the user, at the beginning of the day, would fill the first two (left) tanks 12 and 13 with ceiling coat material and the third and fourth (right) tanks 14, 15 with wall coating materials. Water is added to the dry materials in the tanks and the two mixing motors 80, 81 are turned on by manually opening the respective flow control vlves 99, 100. Mixing hydraulic motor 80 drives shaft 18 to simultaneously operate the agitator assembly 22 in the first tank 12 and gitator assembly 24 in the third tank 14. The second mixing motor 81 drives shaft 19 to simultaneously operte the agitator assembly 28 in the second tank 13 and agitator 25 in the fourth tank 15. All of the agitator assemblies operate as described above, with the blade element scraping the inner wall 30 of the respective tanks, including scraping at the location of the perforated outlet segments 33-36. During this mixing operation, the materials to be sprayed are fully prepared in each of the four tanks. Once all materials are ready for spraying, the user can spray ceiling material from the first tank 12 through the outlet assembly 41 and materials-discharge pump 53, to and through the first spray assembly 90, as discussed above. At the same time, the user can spray wall coating material from the third tank 14 through outlet assembly 58 and materials-discharge pump 69, to and through the second spraying nozzle 95. When the respective tanks ar empty (which may or not occur at the same time) the cutoff valve for the empty tank is turned off while the cutoff valve for the associated tank is turned on so as to allow flow of fresh material from the associated tank. For example the second tank 13 is associated with the first tank 12 in that they both discharge through the common outlet assembly 41. The fourth tank 15 is associated with the third tank 14 in that they are both discharged through the common outlet assembly 58.

Operation of the outlet assembly 58 and the respective cutoff valve 63, 66 is similar to the operation described above in relation to tanks 12 and 13 and common outlet assembly 41. Materials-discharge pump 69 is driven through direct drive by the hydraulic motor 83. Operation of the hydraulic motor 83 is controlled by the flow control valve 102 in the manner described above in relation to remotely operated control valve 101 and hydraulic motor 82. It will be seen that as flow control valve 102 is opened and fluid flows to the hydraulic motor 83, the presence of fluid, and the fluid pressure is sensed through sensor delivery line 125 and communicated through shuttle valve 137, sensor delivery line 127, shuttle valve 138 and the remaining sensor network to the pressure control assembly 134 of hydraulic pump 75. In the manner stated above, the pressure sensed at sensor delivery lines 125 is accumulated with the fluid pressures sensed at other sensor delivery lines by virtue of the open or closed status of the flow control valves and fluid demands of the respective hydraulic motors 80–84, to affect a fluid flow and pressure from the hydraulic pump, through operation of the pressure control assembly 134, to assure operation of all of the hydraulic motors which are designated to be "on" at the given point and time.

Whereas this invention has been described in detail with particular reference to preferred embodiments thereof, it will be understood that variations and modifications can be effected within the spirit and scope of the invention, as described before and as defined in the appended claims.

We claim:

1. Mix and spray apparatus for mixing and spraying materials for ceilings and walls and the like, said apparatus comprising:

a first tank;

first mixing element for mixing materials placed in said first tank;

first drive shaft connected to said first mixing element for driving said first mixing element;

first hydraulic motor mounted in direct drive relationship with said first drive shaft for turning said first drive shaft and thus driving said first mixing element;

first tank outlet from which material is removed from said first tank;

a second tank;

second mixing element for mixing materials placed in said second tank;

second drive shaft connected to said second mixing element for driving said second mixing element;

second hydraulic motor mounted in direct drive relationship with said second drive shaft for turning said second drive shaft and thus driving said second mixing element;

second tank outlet from which material is removed from said second tank;

common material exhaust assembly for receiving material from both said first tank outlet and said second tank outlet, said common material exhaust assembly comprising a first materials moving pump, third hydraulic motor for driving said first materials moving pump and flow selecting means for selectively opening flow communication between said first tank outlet and said first materials moving pump and between said second tank outlet and said first materials moving pump; and first common spray means for receiving materials from said first materials moving pump and discharging said materials, whereby a continuous operation of materials spraying is maintained through a single, common spray means by mixing materials in the first tank while exhausting materials from the second tank and then mixing materials in the second tank while exhausting materials from the first tank, and selectively exhausting each tank throughthe common exhaust assembly to the common spray means.

2. Apparatus of claim 1, wherein:

each said tank comprises an inner chamber defined by an inner wall supporting materials within said tank;

each said tank outlet comprises a channelling member for directing material to said common material exhaust assembly and further comprising a plurality of openings of predetermined diameter arranged flush with said inner wall of sid tank and providing communication between said inner chamber and said channelling member; and each said mixing element comprises at least a first blade member constructed so as, when said mixing element is driven, to scrape across said plurality of openings at said tank outlet, whereby said mixing element and said tank outlet combine to perform as both a materials grater and system filter assisting in smooth flow of materials at the spray means.

3. Apparatus of claim 1, wherein all three of said hydraulic motors are driven by hydraulic fluid pumped through a hydraulic network by a single hydraulic pump and wherein said apparatus further comprises flow control means associated with each said hydraulic motor for selectively varying the flow of hydraulic fluid to the respective one of said hydraulic motors and further comprises means for varying the displacement of fluid by said single hydraulic pump in response to the selected variance in fluid flow to each said hydraulic motor.

4. Apparatus of claim 1, further comprising:

a third tank;

third mixing element for mixing materials placed in said third tank, said third mixing element being in driven connection with said first drive shaft;

third tank outlet from which material is removed from said third tank:

a fourth tank;

fourth mixing element for mixing materials placed in said fourth tank, said fourth mixing element being in driven connection with said second drive shaft;

fourth tank outlet from which material is removed from said fourth tank;

second common material exhaust assembly for receiving material from both said third tank outlet and said fourth tank outlet, said second common material exhaust assembly comprising a second materials moving pump, fourth hydraulic motor for driving said second materials moving pump and flow selecting means for selectively opening communication between said thrid tank outlet and said second materials moving pump and between said fourth tank outlet and said second materials moving pump; and second common spray means for receiving materials from said second materials moving pump and discharging said materials;

whereby simultaneous spraying of two different materials at two different locations is continuously maintained by alternately mixing and exhausting a first material in and from the first and second tanks and spraying throug the first common spray means, and, simultaneously, alternately mixing and exhausting a second material in and from the third and fourth tanks and spraying through the second common spray means.

5. Apparatus of claim 4, wherein all four of said hydraulic motors are driven by hydraulic fluid pumped through a hydraulic network by a single hydraulic pump and wherein said apparatus further comprises flow control means associated with each said hydraulic motor for selectively varying the flow of hydraulic fluid to the respective one of said hydraulic motors and further comprises means for varying the displacement of fluid by said single hydraulic pump in response to the selected variance in fluid flow to each said hydraulic motor.

6. Apparatus of claim 4, further comprising:

air compressor for supplying compressed air to each of said first common spray means and said second common spray means to assist in discharge of materials from each said spray means; and fifth hydraulic motor mounted in direct drive relationship with said air compressor for driving said air compressor.

7. Apparatus of claim 6, wherein all five of said hydraulic motors are driven by hydraulic fluid pumped through a hydraulic network by a single hydraulic pump and wherein said apparatus further comprises flow control means associated with each said hydraulic motor for selectively varying the flow of hydraulic fluid to the respective one of said hydraulic motors and further comprises means for varying the displacement of fluid by said single hydraulic pump in response to the selected variance in fluid flow to each said hydraulic motor.

8. Apparatus of claim 4, wherein:

each said tank comprises an inner chamber defined by an inner wall supporting materials within said tank;

each said tank outlet comprises a channelling member for directing material to said common material exhaust assembly and further comprising a plurality of openings of predetermined diameter arranged flush with said inner wall of said tank and providing communication between said inner chamber and said channelling member; and each said mixing element comprises at least a first blade member constructed so as, when said mixing element is driven, to scrape across said plurality of openings at said tank outlet, whereby said mixing element and said tank outlet combine to perform as both a materials grater and system filter assisting in smooth flow of materials at the spray means.

9. Apparatus of claim 1, further comprising:

a hydraulic fluid reservoir containing hydraulic fluid;

a primary hydraulic pumping means for pumping hydraulic fluid from said reservoir to each of said hydraulic motors, said pumping means including a fluid inlet port, fluid outlet port and pressure compensation means for varying fluid displacement by the pump means in response to variance in a sensed pressure;

fluid delivery network comprising fluid conduit connecting the output port of said pumping means to each of said hydraulic motors, said motors being arranged in parallel flow arrangement relative to one another;

a plurality of flow control devices connected to said fluid delivery network, each said flow control device of said plurality of flow control devices being associated with one of said hydraulic motors to selectively vary the rate of fluid flow from said pumping means to the respective one of said hydraulic motors, each said flow control device comprising only two fluid ports, being a fluid inlet port in communication with said pumping means and a fluid outlet port in communication with the respective one of said hydraulic motors, and further comprising inner chamber means for connecting said input port and said output port and adjustment means for adjusting flow of fluid through said inner chamber means to vary a flow rate between ranges of fully open and fully closed;

flow sensing network connecting said fluid delivery network to said pressure compensation means of said pumping means, said flow sensing network comprising flow means associated with each flow control device—hydraulic motor combination for communicating to said pressure compensation means the relative fluid pressures at each of said flow control device—hydraulic motor combinations; and fluid return network comprising fluid conduit connecting each of said hydraulic motors to said reservoir.

* * * * *